US008763939B2

(12) United States Patent
Komarovsky et al.

(10) Patent No.: US 8,763,939 B2
(45) Date of Patent: Jul. 1, 2014

(54) METHOD OF ACTIVE IMPACT CRUSHING OF MINERALS

(75) Inventors: Andrey Evarestovich Komarovsky, St. Petersburg (RU); Evarest Boleslavovich Komarovsky, St. Petersburg (RU)

(73) Assignee: Roof Corp., Belize City (BZ)

( * ) Notice: Subject to any disclaimer, the term of this patent is extended or adjusted under 35 U.S.C. 154(b) by 55 days.

(21) Appl. No.: 13/452,924

(22) Filed: Apr. 22, 2012

(65) Prior Publication Data

US 2013/0277465 A1 Oct. 24, 2013

(51) Int. Cl.
*B02C 13/09* (2006.01)

(52) U.S. Cl.
USPC ..... 241/27; 241/29; 241/187

(58) Field of Classification Search
USPC ..... 241/27, 29, 154, 187, 275
See application file for complete search history.

(56) References Cited

U.S. PATENT DOCUMENTS

| | | | | |
|---|---|---|---|---|
| 2,292,852 A * | 8/1942 | Werner | ..... | 241/189.1 |
| 2,862,669 A * | 12/1958 | Rollins | ..... | 241/80 |
| 5,328,103 A * | 7/1994 | Komarovsky | ..... | 241/5 |

FOREIGN PATENT DOCUMENTS

| | | | | |
|---|---|---|---|---|
| EP | 583515 A1 * | 2/1994 | ..... | B02C 13/20 |
| RU | 2029616 C1 | 2/1995 | | |
| RU | 2029617 C1 | 2/1995 | | |
| RU | 2111055 C1 | 5/1998 | | |

OTHER PUBLICATIONS

"Making an Impact", Quarry Management, Nottingham, US (Apr. 2004) (entire article).*
"Rotary crushers", edited by Bauman V.A., Moscow, Mashinostroenie, (1973), pp. 44-45 (English translation of abstract only).
Komarovsky, E.B., "Destruction of minerals", Yakutsk, Yakutsk's branch of Siberian Division of Academy of Sciences of USSR (1983) (English translation of abstract only).
Komarovsky, E.B., "A perspective method of destruction of minerals," Science and Education, No. 3, Yakutsk (1996) (English translation of abstract only).
Komarovsky, E.B. "Technology, equipment and source of raw minerals for delfs of construction material industry", St. Petersburg (2004) (English translation of abstract only).
"Making an impact", Quarry Management, Nottingham, UK (Apr. 2004) (English translation of abstract only).

* cited by examiner

*Primary Examiner* — Mark Rosenbaum
*Assistant Examiner* — Leonel Vasquez
(74) *Attorney, Agent, or Firm* — Steven M. War, Esq.

(57) ABSTRACT

A method of impact crushing of material includes the following steps: the material is fed to a rotor crushing the material and forwarding pieces of the material towards secondary crushing rotors. Small material pieces are hit by the first secondary crushing rotor and large material pieces are impacted by the second secondary crushing rotor. Impact surfaces of the secondary crushing rotors are substantially normal to the movement directions of the pieces during the impacts. A time interval between the impacts made by the secondary crushing rotors is defined with use of the expression $\Delta t=(0.7 \ldots 1.3)(R_1/V_1-R_2/V_2)$, where $R_1$ and $R_2$ are distances from a place of forwarding the pieces by the rotor to the places, where the first and second secondary crushing rotors impact the pieces, correspondingly, $V_1$ and $V_2$ are average velocities of the pieces forwarded towards the first and second secondary crushing rotors, correspondingly.
An impact crusher is disclosed as well.

5 Claims, 11 Drawing Sheets

METHOD OF ACTIVE IMPACT CRUSHING OF MINERALS

TECHNICAL FIELD

The invention relates to methods of crushing solid mineral and is recommended to be applied in the mineral resource industry and the mineral processing industry, the building material industry, the mining and coal industries, highway engineering, metallurgy and other fields, where processing of solid mineral and industrial raw material is carried out.

BACKGROUND OF THE INVENTION

The applied method is a result of development and enhancement of the method of impact crushing of the U.S. Pat. No. 5,328,103 which we call a method of active impact crushing. FIG. 1 shows the motion of mineral pieces a) while coming along a feed track and into a zone of rotor rotation and b) during the scattering of the pieces after an initial impact.

The U.S. Pat. No. 5,328,103 discloses the method, when the mineral pieces of different sizes come along the feed track into the zone of the rotor rotation. It was assumed that the size of a piece coming into contact with the rotor does not matter and velocity vectors of the pieces thrown off towards rotatable secondary crushing rotors depend only on the amount of their travel along the impact surface of the rotor.

The described method is implemented by impact crushers of different power and output, which are disclosed in the U.S. Pat. No. 5,328,103 as well, and is used in real industrial operating conditions in the processing of ore and non-metallic mineral. In such an impact crusher secondary crushing rotors (rotors of the secondary crushing) are rotatable synchronously with the rotor (the initial crushing rotor) and have concavo-concave impact active reflecting surfaces, wherein their masses increase from the centers of the rotor rotation along the general symmetry axes, and the radiuses of the active reflecting surfaces are equal to the distance from the point of crossing of the feeding track plane and the circumference of the initial crushing rotor to the common active reflecting surface of the secondary crushing rotors. In this crusher the initial crushing rotor operates as a forwarding rotor, which forms the portions of the material to be crushed, partially crushing the pieces of the material to be crushed and forwards them towards the secondary crushing rotors (reflecting elements), which crush the arriving material to particles of a certain size depending on the set modes by use of the method using the active impact and therefore they are called the rotors of active impact. Additionally, a principle of counter and high-speed dynamic interaction of impact elements and material to be crushed is carried out.

The crushers using the active impact have high efficiency of crushing and grinding of mineral and can avoid multistage and multiprocess ore pretreatment. Despite the advantages, the method has shortcomings. During the use of the crushers it was seen that the crushing efficiency is limited, processing time is increased and regrinding of the crushed product occurs, which leads to unnecessary energy consumption.

It is known in the ore mining that the ore regrinding leads to significant losses of useful components during the enrichment process. The production of the regrinded material with the size of particles less than 2 to 4 millimeters is extremely undesirable in the construction material industry, especially in highway engineering, because such material is not used and this leads to adverse economic and ecological side effects. This is typical, for example, for jet mills, devices using the method of "the step crushing".

SUMMARY OF THE INVENTION

The present invention includes a method of an impact crushing of material with use of a crusher comprising a feed track, a rotor with one or more impact surfaces and two secondary crushing rotors with impact surfaces. The rotor and the secondary crushing rotors are rotatable synchronously. The method includes the following steps: the material is fed with use of the feed track to the rotor; the material is crushed by the rotor to pieces of different sizes and is forwarded towards the secondary crushing rotors; and the material pieces forwarded towards the secondary crushing rotors are then hit by the impact surfaces of the secondary crushing rotors. The material pieces forwarded towards the first secondary crushing rotor are impacted by the impact surface of the first secondary crushing rotor and the material pieces forwarded towards the second secondary crushing rotor are impacted by the impact surface of the second secondary crushing rotor. An angle between the impact surface of the each secondary crushing rotor interacting with the material pieces forwarded towards it and movement directions of these material pieces has a value from approximately 76 to approximately 104 degrees at the moment of the impact. The material pieces are hit by the secondary crushing rotors with a time interval between impacts of the first and second secondary crushing rotors defined with use of the expression $$\Delta t=(0.7\ldots1.3)(R1/V1-R2/V2),$$

where:

R1 is a distance from a place, where the most distant from the rotor rotation axis point of the impact surface of the rotor is at the minimum distance from the end of the feed track, to the place, where the first secondary crushing rotor impacts the material pieces;

R2 is a distance from the place, where the most distant from the rotor rotation axis point of the impact surface of the rotor is at the minimum distance from the end of the feed track, to the place, where the second secondary crushing rotor impacts the material pieces;

V1 is an average velocity of the material pieces forwarded towards the first secondary crushing rotor; and V2 is an average velocity of the material pieces forwarded towards the second secondary crushing rotor.

The present invention includes an impact crusher comprising a body containing a feed track, a rotor with one or more impact surfaces and two secondary crushing rotors with impact surfaces. The rotor and the secondary crushing rotors are rotatable synchronously. The rotor is able to hit material fed by the feed track and forward material pieces towards the secondary crushing rotors. The secondary crushing rotors are able to then hit the material pieces forwarded towards them by impact surfaces of the secondary crushing rotors. The rotor and secondary crushing rotors are rotatable in such a way that an angle between the impact surface of the each secondary crushing rotor interacting with the material pieces forwarded towards it and movement directions of these material pieces has a value from approximately 76 to approximately 104 degrees at the moment of the impact. The secondary crushing rotors are rotatable in such a way that a value of a time interval between the impacts made by the impact surfaces of the first and second secondary crushing rotors on the material pieces forwarded towards them is defined with use of the expression $$\Delta t=(0.7\ldots1.3)(R1/V1-R2/V2);$$

where R1 is a distance from a place, where the most distant from the rotor rotation axis point of the impact surface of the rotor is at the minimum distance from the end of the feed track, to the place, where the first secondary crushing rotor hits the material pieces;

R2 is a distance from the place, where the most distant from the rotor rotation axis point of the impact surface of the rotor is at the minimum distance from the end of the feed track, to the place, where the second secondary crushing rotor hits the material pieces;

V1 is an average velocity of the material pieces forwarded towards the first secondary crushing rotor; and V2 is an average velocity of the material pieces forwarded towards the second secondary crushing rotor.

DETAILED DESCRIPTION

The object of the present invention is to develop the method of the impact crushing, which increases crushing efficiency, the crushed product quality and at the same time decreases the power consumption of the process. The object is to avoid regrinding of the material and to reduce duration of the crushing as well. The additional object of the present invention is to ensure that flows of the material to be crushed are not obstacles for each other in the crusher during the crushing process.

Figure 1A:
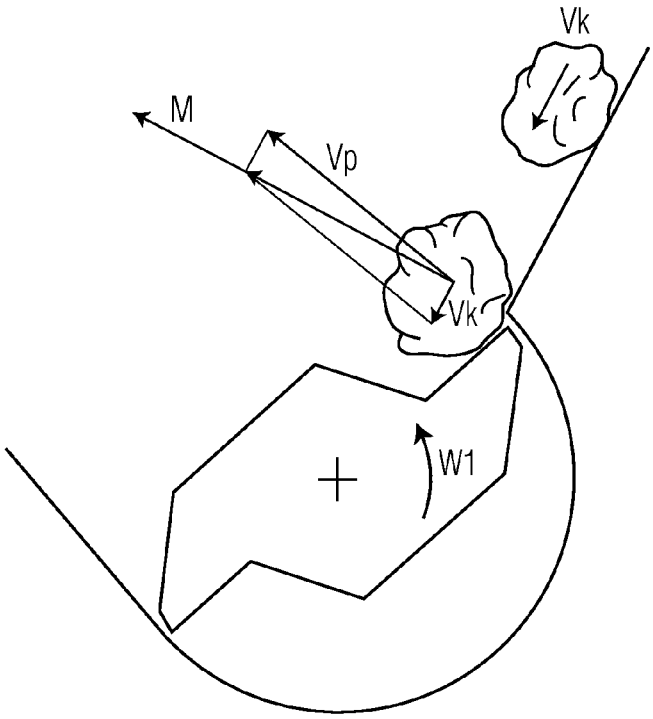
FIG. 1 shows a method of active impact crushing.
Figure 1B:
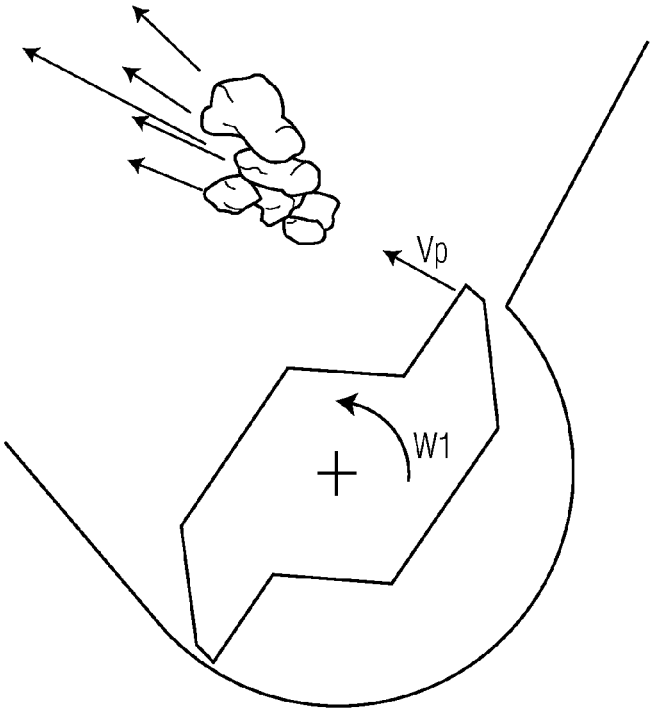
Figure 1C:
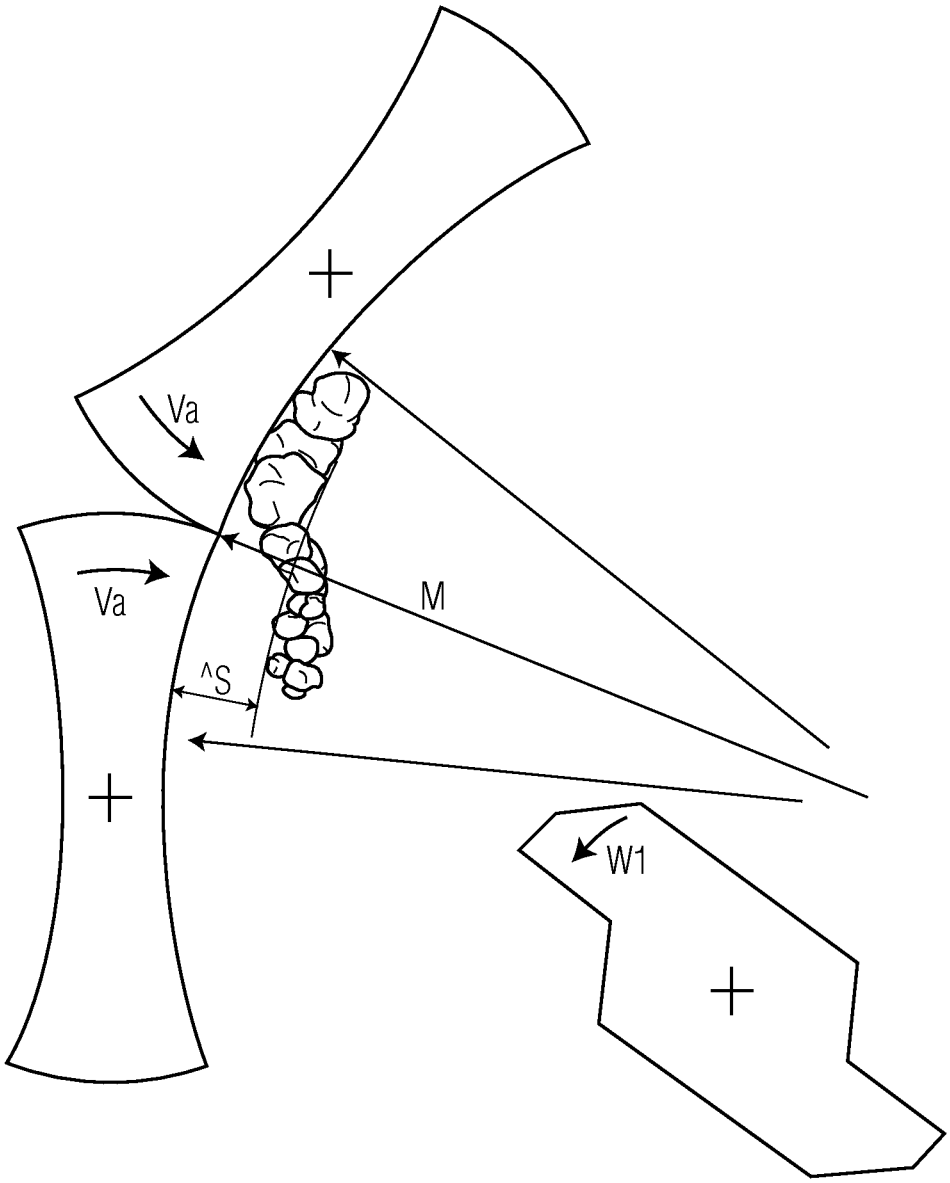

During the use of the crushers it was revealed that (as FIG. 1 *c*) shows) small pieces come to a secondary crushing rotor with a lag relative to arrival of large pieces to the secondary crushing rotor, the lag depending on the size and the velocity of the pieces. In this case crushing occurs sequentially—the material is first being crushed through interaction with the upper (second) secondary crushing rotor and later—in a certain time interval—through interaction with the lower (first) secondary crushing rotor.

The reason of the reduced efficiency of the crusher is that neither the velocities nor the sizes of the pieces of the material to be crushed and forwarded by the rotor to the secondary crushing rotors are taken into account. Without taking into account these factors it is impossible to achieve the enhanced crushing efficiency in full measure, this can especially be observed in processing of strong and very strong mineral. Two secondary crushing rotors forming the common secondary crushing rotor at the moment of the impact with the material to be crushed (the moment of the secondary impact) cannot come into contact with the large and small pieces of the material simultaneously or in such a way, that the impact surfaces of the secondary crushing rotors are normal (perpendicular) to the flight directions of the large and small piece. This is because at first the large pieces fly up to this surface and only then do the small pieces, wherein the large and small pieces fly up with different velocities. It is shown in the paper "Rotary crushers" edited by Bauman V. A., Moscow, Mashinostroenie, 1973, pp. 44-45. In accordance with this paper the velocity of the less crushed (i.e. larger) pieces can increase the average velocity of the pieces up to 2 times. Thus, if the large pieces came to the secondary crushing rotor earlier than the small pieces were crushed by the impact surface of the secondary crushing rotor normal to the direction of the pieces flight, the small pieces cannot be efficiently crushed since the secondary crushing rotor had time to turn and its impact surface is no longer normal to the flight direction of the small pieces. And vice versa, if the small pieces come to the secondary crushing rotor at the time when its impact surface is normal to the flight direction of these pieces and therefore they are efficiently crushed, the large pieces which arrived earlier would not be crushed since the impact surface of the secondary crushing rotor was not normal to the flight direction of the pieces when they struck because the secondary crushing rotor did not have enough time to come into the perpendicular or close to perpendicular position.

Therefore, to solve the object of the present invention, the secondary crushing rotors should crush the pieces of the material forwarded to them in such a way that the impact surfaces of the both secondary crushing rotors are normal to the flight directions of the pieces of the material to be crushed during interaction of the impact surfaces and the pieces of the material. Such a result can be achieved as well, if the secondary crushing rotors interact with the large and small pieces of material to be crushed simultaneously.

It was determined that the crushing efficiency is reduced and processing time is increased because the material concentrating in one place overloads the rotor and the grate as well. It was determined that the material regrinding occurs and a removal of the grinded product from the process is slowed throughout a purposive mutual collision of the flows of the particles of the mineral being crushed. The material crushed by the upper secondary crushing rotor is thrown off into the zone of rotor rotation and is partly mixed with the newly arriving material, but the main part of the material goes to a grate under the rotor. Then the material crushed by the lower secondary crushing rotor is thrown off into the same zone.

This means that the efficiency is reduced and the power required for the crushing increased, because input power is also expended for plastic deformation, which does not result in the crushing but uses the majority of the input power. The reason for the excessive grinding, the restrained crushing productivity and the increased consumption of the supplied electric power is the absence of devices for distribution and control of flows of the crushed to the necessary size participles of the material in the crusher in order to avoid crossing of these flows with each other in time.

The main object of the present invention is solved by a method of impact crushing of material with use of a crusher comprising a feed track, an rotor with one or more impact surfaces and two secondary crushing rotors with impact surfaces, wherein the rotor and the secondary crushing rotors are rotatable synchronously, the method includes the following steps;

the material is fed with use of the feed track to the rotor;

the material is crushed by the rotor to pieces of different sizes and is forwarded towards the secondary crushing rotors;

the material pieces forwarded towards the secondary crushing rotors are then impacted by the impact surfaces of the secondary crushing rotors, wherein the material pieces forwarded towards the first secondary crushing rotor (the small pieces) are hit by the impact surface of the first secondary crushing rotor and the material pieces forwarded towards the second secondary crushing rotor (the large pieces) are impacted by the impact surface of the second secondary crushing rotor.

The method is characterized in the following.

In order to increase the efficiency and productivity of mineral crushing an angle between the impact surface of the each secondary crushing rotor interacting with the material pieces forwarded towards it and movement directions of these material pieces has a value from 76 to 104 degrees at the moment of the impact, wherein the material pieces are impacted by the secondary crushing rotors with a time interval between impacts of the first and second secondary crushing rotors defined with use of the expression $$\Delta t=(0.7 \ldots 1.3)(R_1/V_1-R_2/V_2),$$

where $R_1$ is a distance from a place, where the most distant from the rotor rotation axis point of the impact surface of the rotor is at the minimum distance from the end of the feed track, to the place, where the first secondary crushing rotor hits the material pieces, $R_2$ is a distance from the place, where the most distant from the rotor rotation axis point of the impact surface of the rotor is at the minimum distance from the end of the feed track, to the place, where the second secondary crushing rotor hits the material pieces, $V_1$ is an average velocity of the material pieces forwarded towards the first secondary crushing rotor, and $V_2$ is an average velocity of the material pieces forwarded towards the second secondary crushing rotor.

The part of the expression (0.7 . . . 1.3) indicates a factor having a value from 0.7 to 1.3. Any value of the factor in this range ensures efficiency of the disclosed method. In a preferable embodiment of the invention in order to maximize efficiency of the method the time interval is defined with use of the expression $\Delta t=R_1/V_1-R_2/V_2$. i.e. the factor has unit value.

In order to increase the efficiency and productivity of crushing the mineral forwarded by the rotor flow, the material to be crushed is divided into two flows at the moment of an interaction with the secondary crushing rotors.

At the moment of impacts, each impact surface of the secondary crushing rotor interacting with the material pieces is preferably at the angle from 76 degrees to 104 degrees (i.e. substantially normal, 90 degrees plus-minus 14 degrees) to the movement direction of the material pieces. The position of the impact surfaces can be provided by concentric shapes of the impacting surfaces of the secondary crushing rotors and concentric arrangement of the impacting surfaces of the secondary crushing rotors during the impacting the material pieces relative to the most distant from the rotor rotation axis point of the impact surface of the rotor is at the minimum distance from the end of the feed track.

To produce homogeneous material of larger fraction, for example, macadam (gravel), in one embodiment the mode of crushing providing the relations $$V_1=(0.1 \ldots 0.35)(V_p+V_{a1}),$$

$$V_2=(0.1 \ldots 0.35)(V_p+V_{a2}),$$

where $V_p$ is the linear velocity of the most distant from the rotor rotation axis point of the impact surface of the rotor is at the minimum distance from the end of the feed track, $V_{a1}$ and $V_{a2}$ are the linear velocities of the most distant from corresponding secondary crushing rotor rotation axes points of the impact surfaces of the first and second secondary crushing rotors, is set by adjustment of the velocities of the rotor and the secondary crushing rotors, and the material interacted with the secondary crushing rotors is forwarded to limiters set tangentially relative to the direction of the material pieces motion. The limiters could be moveable, in this case they should be openable, i.e. be relocatable to the tangential position relatively to the direction of the material motion in order to function as passive secondary crushing rotors. The secondary crushing rotors advantageously have identical lineal dimensions, angular velocities of rotation and identical linear velocities.

In order to increase the crushing efficiency and reduce the material regrinding the material crushed throughout the interaction with the secondary crushing rotors and consisting of the particles less than 0.2 millimeters can be removed from the process preferably by means of suction devices disposed in the crushing chamber, for example, under the limiters.

To ensure that flows of the material to be crushed are not obstacles for each other in the crusher during the crushing process, the material pieces interacted with the second secondary crushing rotor can be forwarded to a zone under the first secondary crushing rotor by additional secondary crushing rotor.

In order to increase the efficiency of mineral crushing during concentrating the material forwarded by the additional secondary crushing rotor to a zone under the first secondary crushing rotor (for example, to a limiter disposed under the first secondary crushing rotor) can be forwarded to the impact surface of the second secondary crushing rotor, wherein the effective cross-sections of the limiters are preferably closed.

The object of the present invention is also solved by an impact crusher for implementing the aforesaid methods comprising a body containing a feed track, a rotor with one or more impact surfaces and two secondary crushing rotors with impact surfaces, wherein the rotor and the secondary crushing rotors are rotatable synchronously. Rotation synchronism could be obtained by a kinematical connection. The rotor is able to impact material fed by the feed track and forward material pieces towards the secondary crushing rotors. The secondary crushing rotors are able to then impact the material pieces forwarded towards them by their impact surfaces.

In order to increase the efficiency of crushing and the quality of the product, the crusher the rotor and secondary crushing rotors are rotatable in such a way that an angle between the impact surface of the each secondary crushing rotor interacting with the material pieces forwarded towards it and movement directions of these material pieces has a value from 76 to 104 degrees at the moment of the impact.

The secondary crushing rotors are rotatable in such a way that a value of a time interval between the impacts made by the impact surfaces of the first and second secondary crushing rotors on the material pieces forwarded towards them is defined with use of the expression $$\Delta t=(0.7 \ldots 1.3)(R_1/V_1-R_2/V_2),$$

where $R_1$ is a distance from a place, where the most distant from the rotor rotation axis point of the impact surface of the rotor is at the minimum distance from the end of the feed track, to the place, where the first secondary crushing rotor hits the material pieces, $R_2$ is a distance from the place, where the most distant from the rotor rotation axis point of the impact surface of the rotor is at the minimum distance from the end of the feed track, to the place, where the second secondary crushing rotor hits the material pieces, $V_1$ is an average velocity of the material pieces forwarded towards the first secondary crushing rotor, and $V_2$ is an average velocity of the material pieces forwarded towards the second secondary crushing rotor.

0.7 . . . 1.3 is a factor taking into account dynamics of the collision process for a given fineness of the initial material and defined characteristics of a grain-size composition of the crushing product.

In a preferable embodiment of the crusher the value of the time interval is defined with use of the expression $\Delta t=R_1/V_1-R_2/V_2$.

The secondary crushing rotors are preferably rotatable in such a way that their impact surfaces are preferably at the angle from 76 degrees to 104 degrees (i.e. substantially normal) to the movement direction of the material pieces interacting with them. The aforesaid arrangement of the impact surfaces of the secondary crushing rotors relatively to the movement directions of the pieces can be achieved by concentric shape of the impacting surfaces and their concentrically arrangement during the impacting the material pieces relative to the most distant from the rotor rotation axis point of the impact surface of the rotor is at the minimum distance from the end of the feed track.

The crusher preferably comprises an additional secondary crushing rotor located between the rotor and the second secondary crushing rotor and reflecting the material pieces forwarded by the second secondary crushing rotor to a zone under the first secondary crushing rotor. This feature prevents the flows of the crushed material from being obstacles to each other during the process of crushing.

The additional secondary crushing rotor is advantageously located between the rotor and the second secondary crushing rotor in the vertex of the triangle having a base passing from the place, where the most distant from the rotor rotation axis point of the impact surface of the rotor is at the minimum distance from the end of the feed track, to a place, where the most distant from corresponding secondary crushing rotor axes points of the impact surfaces of the secondary crushing rotors are at the minimum distance from each other, wherein the angle between the base of the triangle and a side of the triangle connecting the center of a secondary crushing rotor of the additional secondary crushing rotor and the place, where the most distant from the rotor rotation axis point of the impact surface of the rotor is at the minimum distance from the end of the feed track, is about 35 degrees plus-minus 10 degrees. In the preferable embodiment the additional secondary crushing rotor can adjust its angular position within the limits of 20 degrees to each direction relative to its middle angular position. A turning axis can be located in the center of the additional secondary crushing rotor and a hinge is advantageously placed in the upper or lower part of the element.

The crusher preferably contains limiters forming a gap between the rotor or the secondary crushing rotor and a surface of the limiter. These limiters can be moveable in grooves of the crusher body and forming the necessary gaps between the ends of the impact elements of the rotor or the secondary crushing rotor and working surfaces of the limiters. Moreover, the limiters can have clearing openings, which can be adjustable on their effective cross-sections.

In one embodiment a bumper is located between the limiters of the rotor and the first secondary crushing rotor; the bumper can be attached to the limiters. The bumper can comprise clearing openings.

In the preferable embodiment of the crusher the feed track is adjustable on the position of the feed track end with respect to the rotor (i.e. with respect to the point of loss of the contact of the material to be crushed with its surface). For this purpose the feed track can comprise a pivoted hinge at the upper part of the feed track and fixing means at the lower part of the feed track and the fixing means could be able to fix the feed track continuously or discretely up to 15 degrees to each direction from the middle position of the feed track.

The distances $R_1$ and $R_2$ preferably have the following relation: $R_1 \leq R_2 \leq (V_2/V_1)R_1$.

In one of the embodiments the distance $R_2=(V_2/V_1)R_1$ and $\Delta t=0$, i.e. the impact surfaces of the secondary crushing rotors interact with the material pieces simultaneously.

During commercial operation of the active impact crushers there were carried out some experiments directed towards optimization of the process of mineral destruction and revealing of opportunities to increase crushing efficiency using the advantages of the active interaction. It was ascertain in that way that the elimination of the intersection and collision of the flows of the material to be crushed leads to the sufficient increase of crushing efficiency, wherein the reduction of regrinding of the material was noticed as well.

The characterizing feature of the method of active impact crushing is that directed impacts of the secondary crushing rotors are synchronized with the impacts of the rotor and their impact surfaces are oriented perpendicularly to the velocity vectors of the pieces forwarded by the rotor, wherein the linear motion velocity of the secondary crushing rotors is preferably 0.3 to 3.5 of the rotor linear velocity.

The proposed method of active impact crushing allows the elimination of the shortcomings of the present crushers by division of the flow of the material forwarded by the rotor into two flows. The time interval between impacts of the secondary crushing rotors on the material pieces is set accordingly their velocity and distance from the place of the rotor impact to the place of the secondary crushing rotor impact.

The proposed method and crusher provide increased crushing efficiency and the quality of the final product. In accordance with the present invention the power consumption per ton of the crushed material is practically 3 and more times less as compared with the crushing methods in operation.

The object of the present invention is to increase the productivity and efficiency of the crushing through elimination of the aforementioned shortcoming, which lies in that the impacting surfaces of the secondary crushing rotors are not normal during the impacts with the flying directions of the pieces of the forwarded material to be crushed to the respective secondary crushing rotors. The said perpendicularity can be achieved by concentric shape of the impacting surfaces and their concentrically arrangement during the hitting of the material pieces relative to the point of the impact surface of the rotor, which is the farthest from the rotor rotation axis, when it is at the minimum distance from the end of the feed track.

It was determined by the investigations that in the impact rotary crushers the deviations of the piece flight directions after the impact of the rotor, where the scattering is fan-shaped, correspond to Gaussian law. The most probable direction of the flight—the average or modal direction—is determined by geometrical sum of velocities $V_k$ of the pieces coming along the feed track to crushing and the velocity $V_p$ of the rotor (see FIG. 1*a*). It was shown that the pieces of small size are thrown off in the modal (the most probable) direction and closer to the rotor (towards the first of lower secondary crushing rotor), and the large pieces are thrown off away from the rotor (towards the second of upper secondary crushing rotor) (see FIG. 1*b*). It should be noted that even if the equal sized pieces come into the crusher, they can be crushed into pieces of different sizes by the impact of the rotor. The rotor can be implemented as a rotatable rotor having one or more impact surfaces.

It was determined that independently of the rotational speed of the rotor the scattering diagram of the material to be crushed does not change: after the primary impact the small pieces scatter in the modal direction and closer to the rotor and the large pieces have a flight vector directed away from the rotor, i.e. in accordance with the influence of the centrifugal forces directed from the center of gravity of each piece.

Such a situation is typical for both the uncrushed pieces of different sizes and partly crushed pieces broken at a plane of the maximum radius of rotation of the rotor throughout the contact of pieces of the material to be crushed with the surface of the crushing element. In other words, investigations reveal that the flow of the impacted by the rotor material is divided at least two flows depending on the angle: the flow of small pieces and the flow of large pieces.

This conclusion was used to invent the method of active impact provided with the synchronization of the impacts of the rotor and secondary crushing rotors and to design the crusher with active impact.

The fulfilled analytical investigations and experiments resulted in the determined fact that the interaction of the mineral pieces of different sizes and having different vector quantities of velocities after the impact of the rotor with the secondary crushing rotors takes place not simultaneously on the whole working surface but with delay of the contact of the small pieces of the material to be crushed and the impact surfaces of the secondary crushing rotors relative to the contact of the large pieces.

The value of this delay is equal to the following:

$$\Delta T = R_1/V_1 - R_2/V_2,$$

where $R_1$ is a distance from a place, where a point of the impact surface of the rotor, which is the farthest from an rotor rotation axis, is at a minimum distance from the end of the feed track (i.e. the place, where the rotor impacts the pieces of the material to be crushed coming along the feed track), to a place, where the material pieces forwarded towards the first secondary crushing rotor are impacted by the impact surface of the first secondary crushing rotor;

$R_2$ is a distance from the place, where the point of the impact surface of the rotor, which is the farthest from the rotor rotation axis, is at the minimum distance from the end of the feed track, to a place, where the material pieces forwarded towards the second secondary crushing rotor are impacted by the impact surface of the second secondary crushing rotor;

$V_1$ is an average velocity of flight of the material pieces forwarded towards the first secondary crushing rotor and $V_2$ is an average velocity of flight of the material pieces forwarded towards the second secondary crushing rotor.

The aforementioned distances and average velocities of flight of the material pieces can be measured experimentally with use of appropriate measuring equipment or by means of video recording, which can be accelerated. The distances $R_1$ and $R_2$ usually are set taking into account dimensions of crushing equipment, fineness (size) of the material to be crushed, conditions of efficient operation of a crusher and relative positions of the rotor and the secondary crushing rotors. Principles and examples of selection of these distances can be found in the state of the art. The velocities $V_1$ and $V_2$ depend on a linear velocity of the most distant from the rotor rotation axis point of the impact surface of the rotor, which could be determined on the base of an angular velocity of rotor rotation and a distance from the rotor rotation axis of the most distant point of the impact surface, and size and weight of the forwarded material pieces and the velocity of the material being fed by the feed track.

The flow of the partly crushed material directed by the rotor has a shape of a fan consisting of flows of differently sized pieces, this fan-shaped flow has at least two parts depending on fineness. One part flying closer to the rotor gets the impact from the first (lower) secondary crushing rotor having the counter linear velocity $V_{a1}$ of the most distant from the rotation axis point of the impact surface. The other part flying away from the rotor gets the impact from the other (upper) secondary crushing rotor having a counter velocity $V_{a2}$ of the most distant from the rotation axis point of the impact surface. The impacts of the first and second secondary crushing rotors are carried out with time delay, its value (or modulo of value) is determined by the average velocities of flight of the small and large pieces and the distances from the place of forwarding of the said pieces by the rotor towards the secondary crushing rotors:

$$\Delta t = (0.7 \ldots 1.3)(R_1/V_1 - R_2/V_2).$$

The factor (0.7 . . . 1.3) showing the range of possible values of the time interval between impacts made by the secondary crushing rotors reflects characteristics of the fineness of the initial material and the grain-size composition of the crushing product and can take into account manufacturing tolerances and tooling. If the value of the time interval between impacts is within the range, the crushing efficiency is achievable. The efficiency is optimal, when the value of the time interval between impacts is equal to the value of the delay of the small pieces relatively to large pieces.

Because collisions of the impact surfaces of the secondary crushing rotors and the material pieces takes place with the time interval depending on piece velocities and the length of the paths traversed between the rotor and the secondary crushing rotors, the aforementioned perpendicularity or the close to perpendicular value of the angles between the impact surfaces of the secondary crushing rotors and flight directions of the material pieces forwarded towards them is achieved both for the small pieces of material forwarded by the rotor towards the first secondary crushing rotor and the large pieces of material forwarded by the rotor towards the second secondary crushing rotor. In other words, such perpendicularity is achieved both for the first secondary crushing rotor and the second secondary crushing rotor.

The time interval between impacts made by the secondary crushing rotors on the pieces of the material to be crushed can be defined by calculation with use of values of the distances $R_1$ and $R_2$ set on the base of reason from the state of the art and measured values of the material pieces velocities $V_1$ and $V_2$. This time interval can be set by tuning of initial relative positions of rotation of the secondary crushing rotors made in the form of rotatable rotors in such a way that the impact surfaces of the both secondary crushing rotors can be substantially normal to directions of flight of the material pieces at the moments of impacts. Time of the impacts and positions of the impact surfaces of the secondary crushing rotors can be measured, for example, experimentally with use of appropriate equipment or accelerated video recording. Time of impact is determined for the most part (60% or more) of material pieces forwarded to the secondary crushing rotor and can be, for example, averaged for all or part of impacted pieces.

It is shown by experiments that efficient crushing is achieved during collision of the impact surfaces of the secondary crushing rotors with the material pieces at the prescribed distances $R_1$ and $R_2$, if the impact surfaces are at the angle from 76 to 104 degrees to the flight direction of the material pieces at the moment of the impact. The most efficiency is achieved when the impact surfaces are normal (at the angle of 90 degrees) to the flight direction of the material pieces at the moment of the impact. If the value of the angle is outside of the said range (i.e. less than 76 degrees or more than 104 degrees), the crushing efficiency drops below an acceptable value and regrinding can occur. The value of the angle can be calculated or experimentally measured with use of appropriate equipment. This value can be defined with help of video recording as well. The video recording can be, for example, accelerated (made with a speed higher than a speed of viewing).

The substantially normal positions of the impact surfaces of the rotatable secondary crushing rotors relative to flight directions of the material pieces can be set by appropriate initial relative position of rotation of the rotor and the secondary crushing rotors in such a way that the material pieces forwarded by the rotor contact with the secondary crushing rotors having occupied (by means of rotation) positions providing perpendicularity of their impact surfaces and directions of movement of the material pieces forwarded by the rotor. The directions of movement of the material pieces forwarded by the rotor can be approximated by lines (or a fan of lines) connecting the place or point, where the most distant from the rotor rotation axis point of the impact surface of the rotor is at the minimum distance from the end of the feed track (in other words the place where the rotor forwards the material pieces towards the secondary crushing rotors), and the points of the impact surfaces of the secondary crushing rotors.

The initial relative positions of rotation of the rotor and the secondary crushing rotors can be defined by values of time intervals between forwarding the material pieces by the rotor and subsequent impacts of the secondary crushing rotors on the forwarded material pieces, i.e. between the moment of taking by the rotor the position, where the most distant from the rotor rotation axis point of the impact surface of the rotor is at the minimum distance from the end of the feed track, and the moments of taking by the secondary crushing rotors the positions, where their impact surfaces are substantially normal (have angles from 76 to 104 degrees) to the line, connecting the point, where the most distant from the rotor rotation axis point of the impact surface of the rotor is at the minimum distance from the end of the feed track, and the points of these impact surfaces. These time intervals have values of $R_1/V_1$ and $R_2/V_2$ for the first and second secondary crushing rotors correspondingly.

In one embodiment this perpendicularity or near perpendicularity of the angles between the impact surfaces of the secondary crushing rotors and flight directions of the material pieces forwarded towards them is provided with simultaneous impacts between both secondary crushing rotors and the material pieces forwarded towards them. In this case the second secondary crushing rotor should be further than the first secondary crushing rotor, i.e. $R_2=(V_2/V_1)R_1$.

In another embodiment the substantially perpendicular positions of the impact surfaces of the secondary crushing rotors relatively to the flight directions of the material pieces at the moments of the impacts can be achieved for the case when $R_1=R_2=R$ by setting the time interval between the secondary crushing rotors taking the perpendicular positions relative to line connecting the place, where the most distant from the rotor rotation axis point of the impact surface of the rotor is at the minimum distance from the end of the feed track, and the points of the impact surfaces of the first and second secondary crushing rotors equal to $R(1/V_1-1/V_2)$.

After interaction with the second (upper) secondary crushing rotor the material can be forwarded to an additional and mainly passive secondary crushing rotor, which can have concave surface and reflect the material into a zone located under the first (lower) secondary crushing rotor and preferably dimensioned as 0.5 of the rotating radius of the most distant from the rotational axis point of the impact surface of the first secondary crushing rotor, wherein the center of the zone is disposed at a line connecting a rotational axis of the rotor with the rotational axis of the first secondary crushing rotor at a distance of ¾ of the rotating radius of the most distant from the rotational axis point of the impact surface of the first secondary crushing rotor, wherein the material forwarded by the rotor and interacting with the first secondary crushing rotor is preferably forwarded into a space under the rotor.

Implementation of the proposed method is illustrated by FIGS. 2 to 8.

Figure 2:
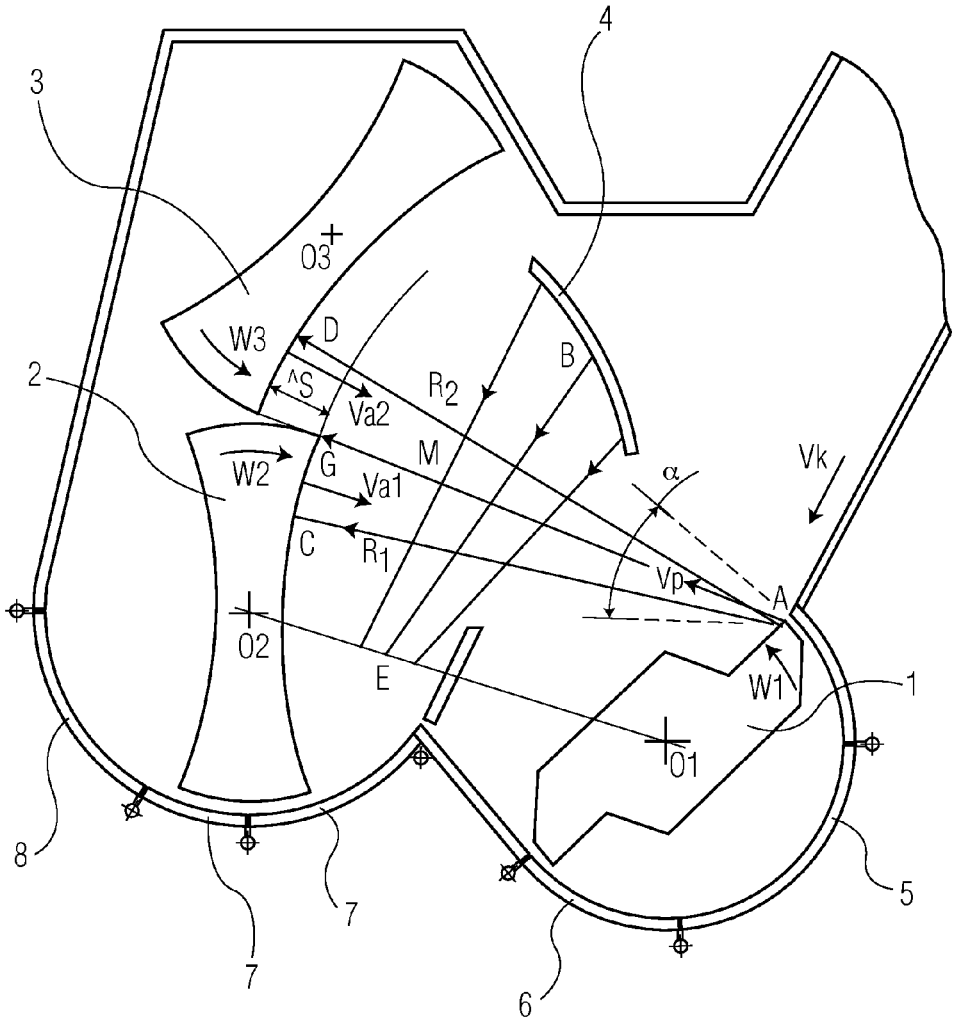
FIG. 2 shows a general diagram of kinetics of material to be crushed.
Figure 3:
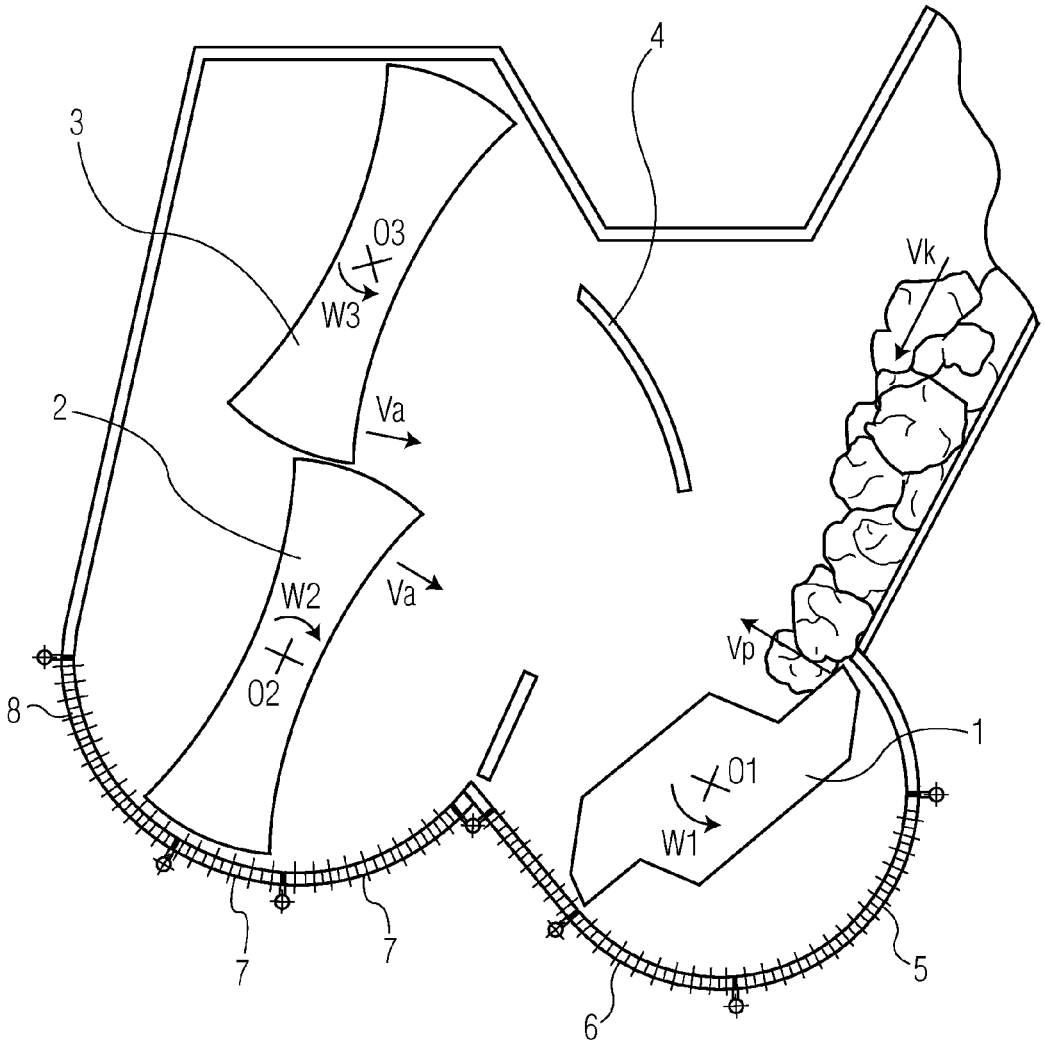
FIG. 3 shows the first stage of kinetics of material to be crushed.
Figure 4:
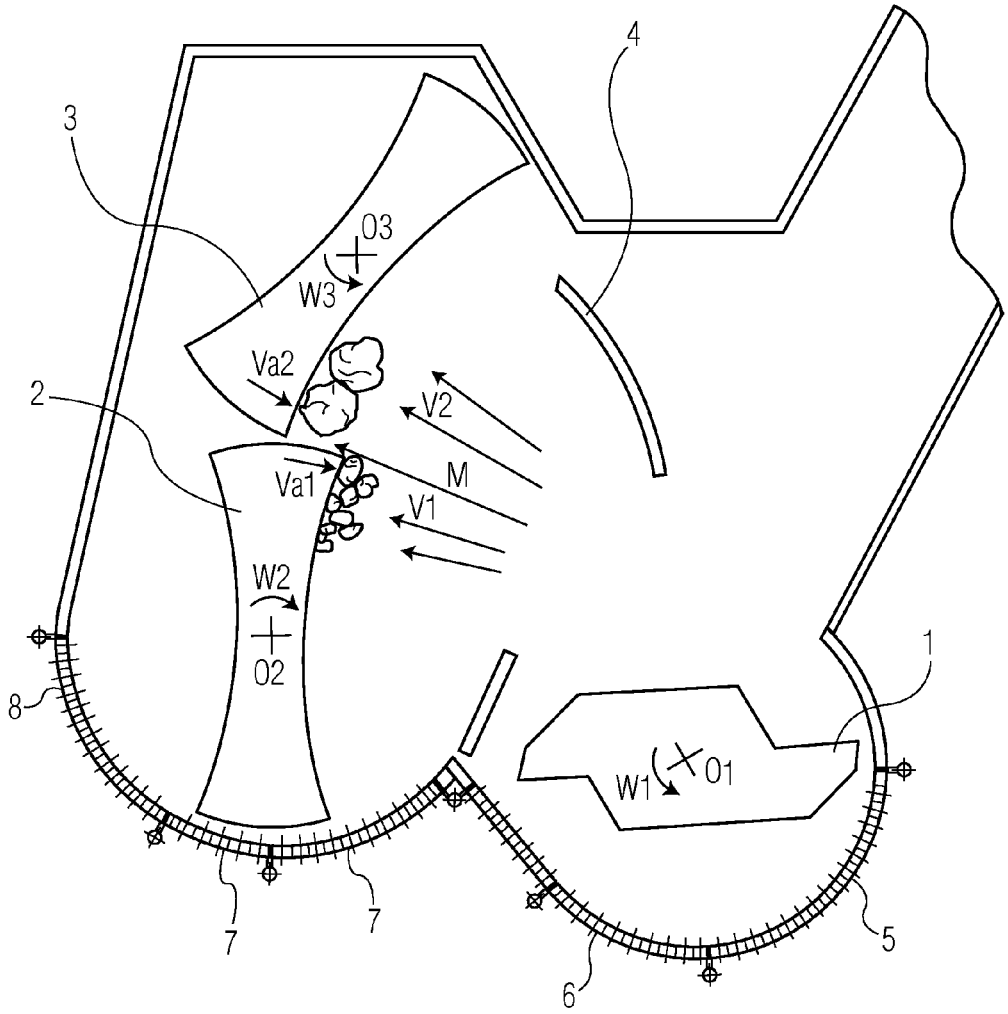
FIG. 4 shows the second stage of kinetics of the material to be crushed.
Figure 5:
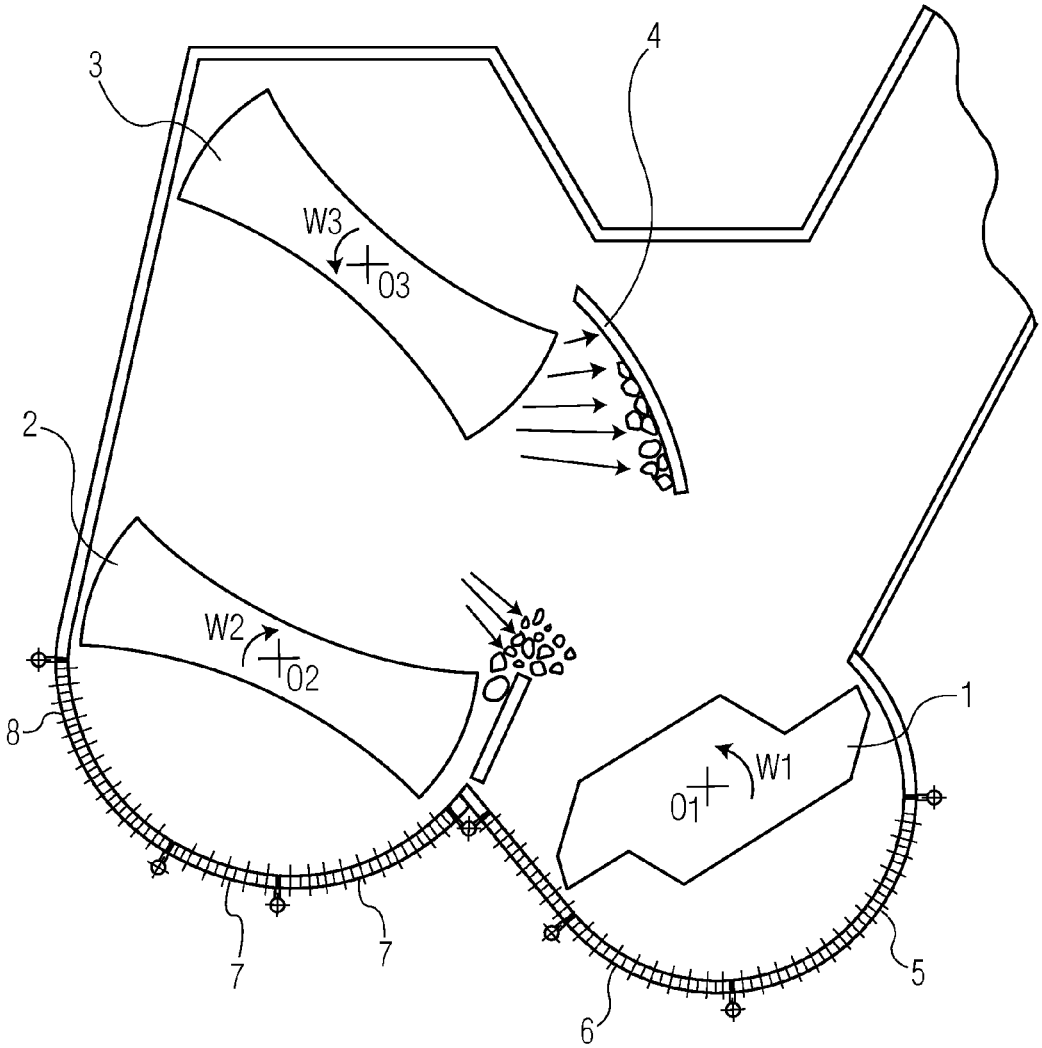
FIG. 5 shows the third stage of kinetics of the material to be crushed.

FIG. 2 shows a general diagram of the method implementation and FIGS. 3, 4, 5, 6 show separate stages of crushing and motion of the crushing product in the embodiment, when $\Delta t=0$ and $R_2=R_1(V_2/V_1)$.

The material is forwarded with the scattering angle alpha (the probability of material getting to the sector of this angle is 92%) from a place of loss the contact of material to be crushed along a line of intersection of the fees track with the rotational circumference of the rotor 1 (the point A) towards secondary crushing rotors having the rotational center O2 of the first (lower) secondary crushing rotor 2 and the rotational center O3 of the second (upper) secondary crushing rotor 3. The average direction of the piece flight (the middle of a fan-shaped flow—mode M) is formed on the line AG. The flight of the smaller pieces passes from the rotor along the line AC (vector $R_1$), and the flight of the larger pieces passes from the rotor along the line AD (vector $R_2$). The distance ˆS formed in accordance with the embodiment of the present invention permits compensation for the lack of the velocity of the smaller pieces and difference of the piece sizes of the material to be crushed and to carry out the interaction of the material with the impact surfaces of the both secondary crushing rotors simultaneously. Taking into account adjustable inertial force of the impact of the secondary crushing rotors, the large and small pieces of the mineral are destroyed up to the fractions determined by the operating conditions.

Further the flow of the crushed material is forwarded from the second secondary crushing rotor 3 to the concave reflecting surface of the additional secondary crushing rotor 4 forwarding the material into the zone E, the center of the zone is on the line connecting rotational axes O1 and O2 of the rotor and the first secondary crushing rotor. The dimension of the zone E is ¼ of the maximum linear dimension of first secondary crushing rotor at a sectional plane orthogonal to the rotation axis. The segment O2E is equal to ¾ of the rotational radius of the point of the secondary crushing rotor 2, which is maximum remote from the rotational axis at the sectional plane orthogonal to the rotational axis, i.e. to ⅜ of the maximum linear dimension of first secondary crushing rotor at the sectional plane orthogonal to the rotational axis from the rotational axis of this element.

The crushed material thrown off from the secondary crushing rotor 2 is forwarded towards the rotor 1. The rotor catches the material and forwards it to the limiters 5 and 6 used for unloading the product.

Figure 6:
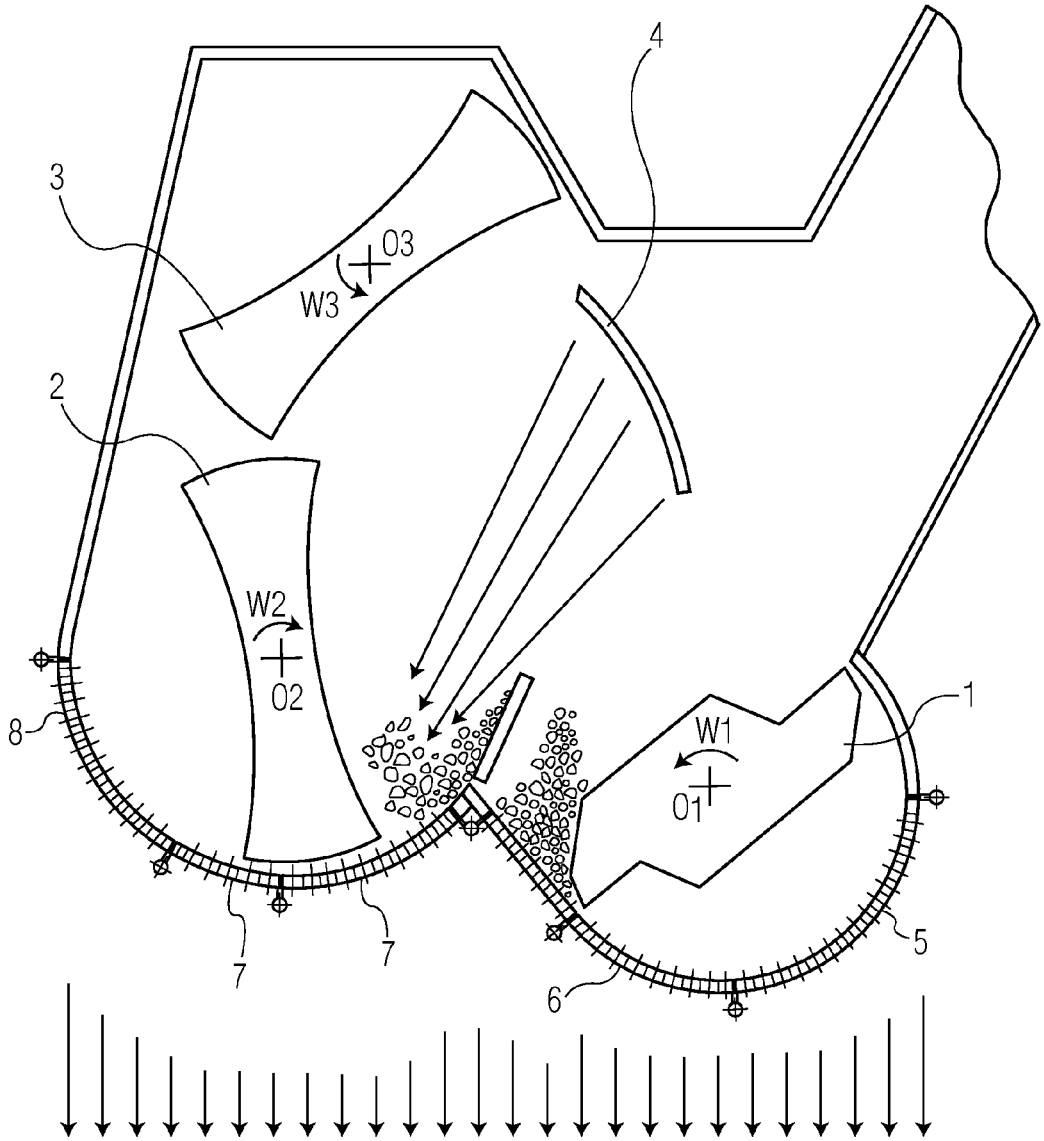
FIG. 6 shows the fourth stage of kinetics of the material to be crushed.

The crushed material forwarded by the additional secondary crushing rotor 4 to the zone E (see FIG. 2) is caught by the secondary crushing rotor 2 and unloaded from the process through the limiters 7 and 8. FIG. 6 shows the final stage of the process.

Figure 7:
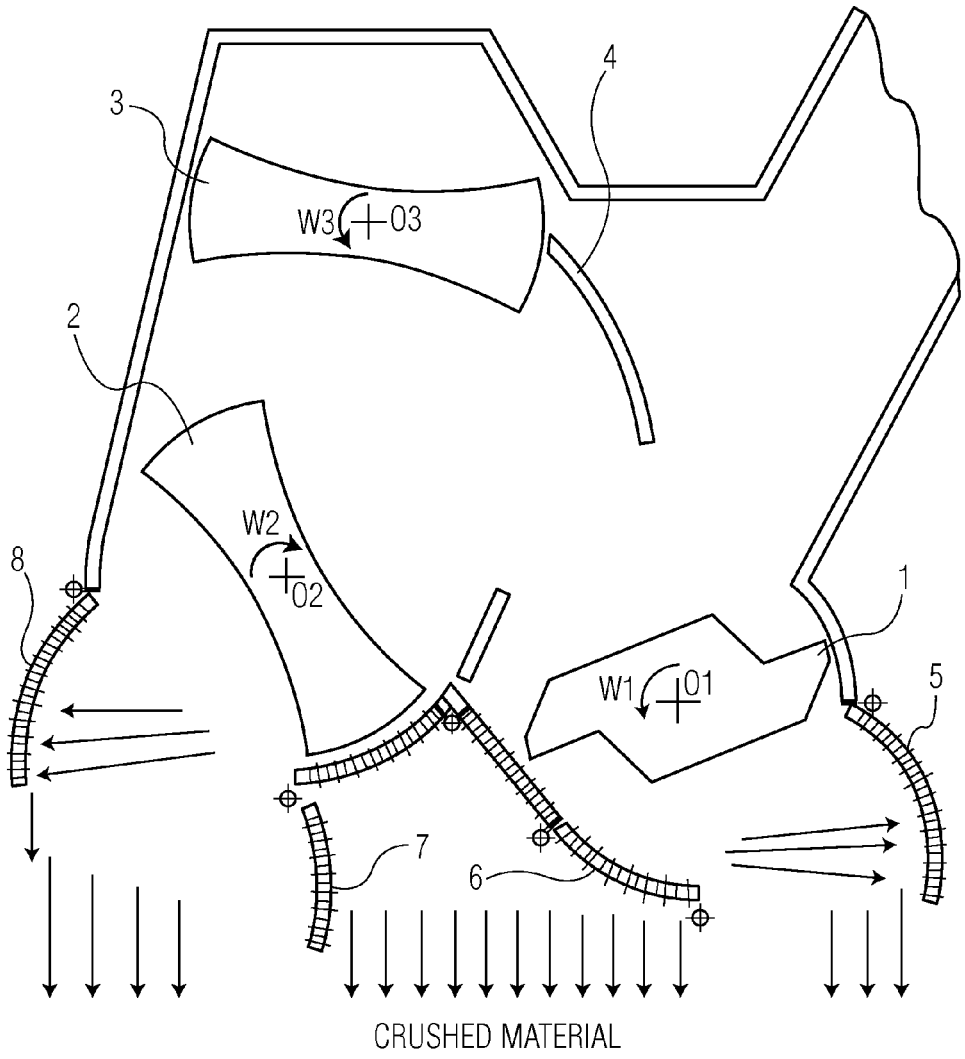
FIG. 7 shows a diagram of the gravel (macadam) producing by crushing.

Another embodiment of the proposed method provides the efficient process of the crushing intended for producing the macadam (gravel) fraction of nonmetallic minerals (5 to 10, 10 to 20, 20 to 40 millimeters, etc.). To implement this process the mode of crushing providing the relations $$V_1=(0.1\ldots0.35)(V_p+V_{a1}),$$

$$V_2=(0.1\ldots0.35)(V_p+V_{a2}),$$

where $V_p$ is the linear velocity of the point of the impact surface of the rotor, which is the most distant from the rotor rotation axis, $V_{a1}$ and $V_{a2}$ are the linear velocities of points of the impact surfaces of the first and second secondary crushing rotors, which are the most distant from secondary crushing rotor rotation axes, is set by adjustment of the velocities of the rotor and the secondary crushing rotors, and the material interacted with the secondary crushing rotors is forwarded to limiters 6 and 7 set tangentially relative to the direction of the material pieces motion (the withdrawing vector of the product) and the limiters 5 and 8 are set into a position for unconfined withdrawal and used as passive bumpers. FIG. 7 shows this diagram. The limiters could be moveable, in this case they should be openable, i.e. be relocatable to the tangential position relatively to the direction of the material motion in order to function as passive secondary crushing rotors.

In order to provide overall grinding of the material to be crushed, which is necessary for concentrating during flotation, and to complete crushing of hard and very hard minerals, the limiters 5, 6, 7, and 8 close the passage for the crushed material and the material is forwarded to the impact surface of the secondary crushing rotor 3 by the secondary crushing rotor 2.

When crushing metallic mineral, the material is basically not strong and easy crushed, there arises a necessity of fast withdrawal of fine grinded product from the process in order to avoid possible regrinding, because if regrinding occurs, a part of the product is lost throughout the concentrating and the technology of concentrating of the fine grinded product becomes difficult to implement.

In order to solve this problem, when the method of active impact crushing resulting in the producing the fine product is carried out, the suction devices tuned to withdrawal of the grinded product less than 0.2 millimeters are proposed to place in the crushing camera under the limiters outside the zone of impacts.

Figure 8:
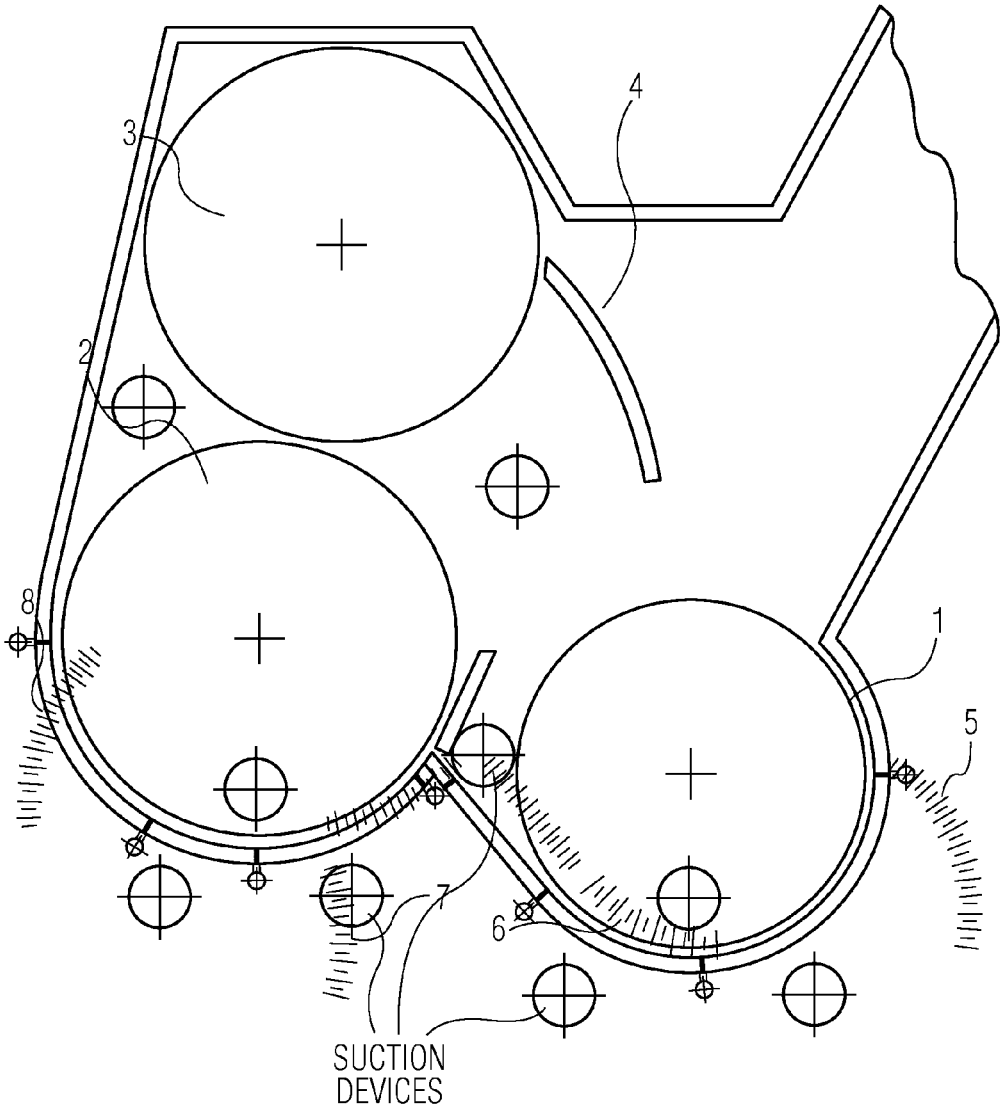
FIG. 8 shows a diagram of the suction device positions.

FIG. 8 shows the diagram of the suction device placement.

It should be mentioned that the flows of the material to be crushed forwarded towards the secondary crushing rotors 2 and 3 do not intersect the flows forwarded by secondary crushing rotors 2, 3 and 4, because their time periods of flight along the said directions are different and do not concur.

The method and its characterizing features were verified by a pilot crusher using active impact.

Figure 9:
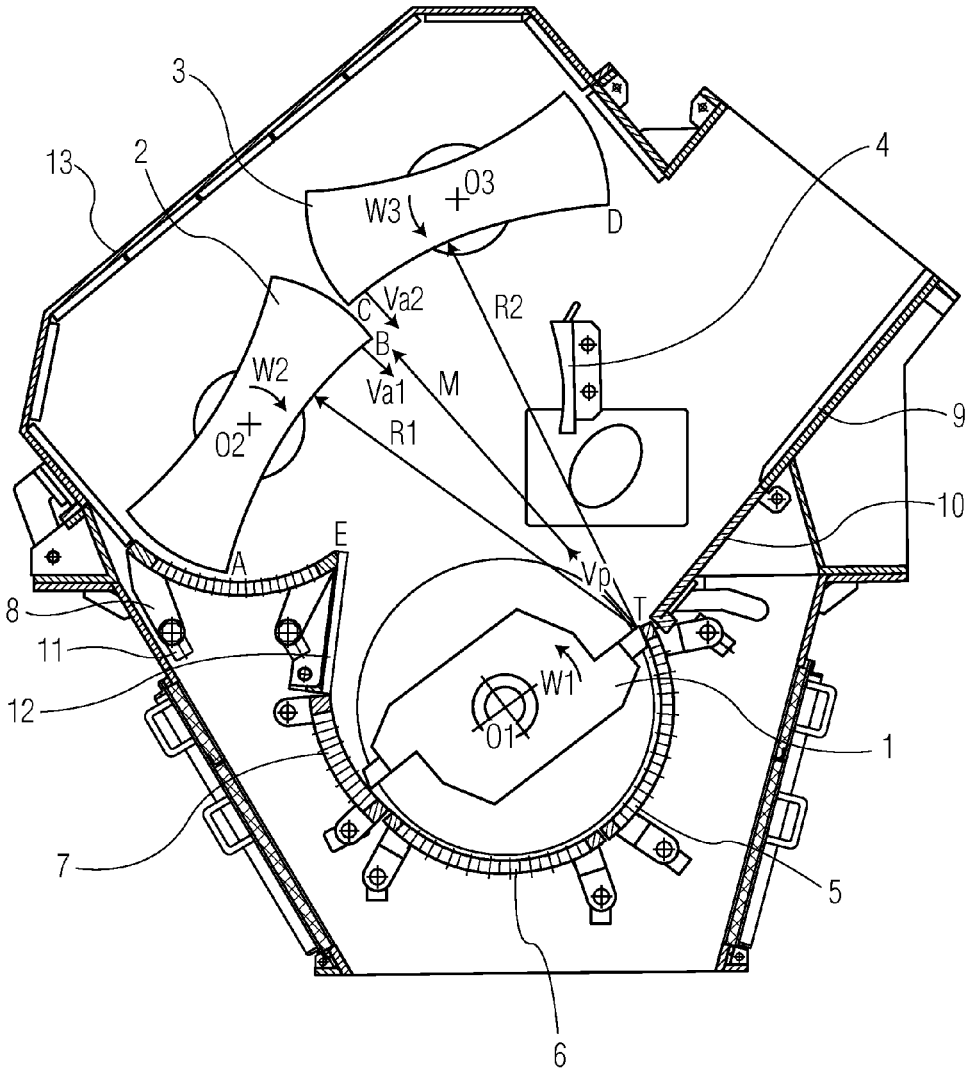
FIG. 9 shows an active impact crusher.

FIG. 9 shows the active impact crusher comprising the aforementioned construction innovations. The impact crusher includes a body 13 housing the secondary crushing rotors (or rotors) 2 and 3, the rotor (or forwarding rotor) 1, the feed track 10, the supplying track 9, the limiters 5, 6, 7, 8, relocating devices in the grooves 11, the buffer 12 and the additional secondary crushing rotor (or reflector) 4.

In the active impact crusher, which body 13 encloses three kinematically connected synchronously rotatable rotors including one forwarding rotor being the rotor 1 and two reflecting rotors being the first (lower) secondary crushing rotor 2 and the second (upper) secondary crushing rotor 3, the feeding hole and the supplying track 9 and the limiters 5, 6 placed under the rotor. The first secondary crushing rotor is rotatable in such a way that it is able to impact forwarded towards it the material pieces at the distance $R_1$ from the point T of loss the contact of the material to be crushed from the feed track and the impact surface of the rotor at the moment of its contact with the material. The second secondary crushing rotor is rotatable in such a way that it is able to impact forwarded towards it the material pieces at the distance $R_2$ from the point T of loss the contact of the material to be crushed with the feed track and the impact surface of the rotor at the moment of its contact with the material.

The secondary crushing rotors are rotatable in such a way that the angle between the impact surface of each secondary crushing rotor interacting with the corresponding material pieces and the movement direction of these material pieces during the impacting the material pieces is 76 to 104 degrees (substantially perpendicular). Such a perpendicularity is provided by concentric shape of the impacting surfaces and their concentrically arrangement during the impacting the material pieces relative to the point of the collision of the rotor and the material to be crushed and by the fact, that the secondary crushing rotors are rotatable in such a way that a value of a time interval between the impacts made by the impact surfaces of the first and second secondary crushing rotors to the material pieces forwarded towards them is defined with use of the expression $\Delta t=(0.7\ldots1.3)(R_1/V_1-R_2/V_2)$, where $V_1$ is an average velocity of the material pieces forwarded towards the first secondary crushing rotor and $V_2$ is an average velocity of the material pieces forwarded towards the second secondary crushing rotor.

In a preferable embodiment of the crusher the value of the said time interval is defined with use of the expression $\Delta t=R_1/V_1-R_2/V_2$.

The additional secondary crushing rotor 4 having concave surface and throwing the material into the zone A-E of the first secondary crushing rotor 2 rotation is placed on the line connecting the point T and the center $O_3$ of rotation of the second secondary crushing rotor 3 and is relocatable relative to the velocity vector of the crushed material reflected by the impact surface of the element 3 within the limits of 20° to each direction relative to its middle position. There are the limiters 5, 6, 7, 8 under the rotor 1 and the element 2, they are moveable in grooves 11 of the crusher body by means of corresponding devices and form the adjustable gaps between the ends of the impact elements and the surfaces of the limiters and also form and adjust sizes of the effective cross-sections in the devices right up to their total closing. In order to produce the pieces of the material to be crushed of the prescribed size the feed track 10 is adjustable with respect to the point T of loss the contact with the material to be crushed, wherein the pivoted hinge is disposed at its upper part and the feed track can be fixed at the lower part continuously or discretely up to 15 degrees to each direction from its middle position. The bumper 12 attached to the limiters 7 and 8 is located between them and forms an expanding conical space between the rotor and the bumper.

Figure 10:
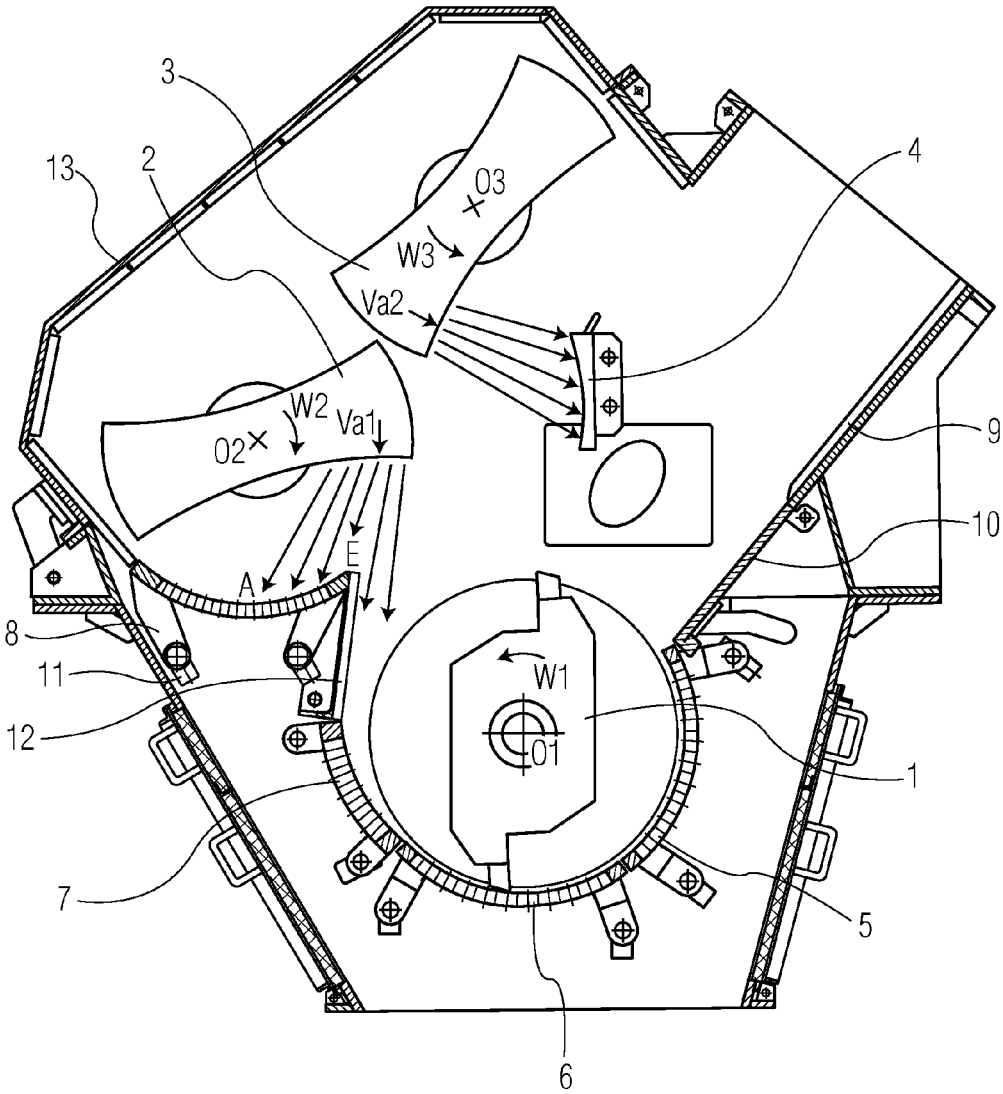
FIG. 10 shows an active impact crusher.

Crushing of mineral schematically shown by FIGS. 9 and 10 occurs as the following. The material to be crushed comes to the crushing chamber through a loading tray along the supplying track 9 and further along the feed track 10 set at necessary angle to one of the impact elements of the rotor 1 rotating at the angular velocity $W_1$, having the linear velocity $V_p$ of the most distant from rotational axis point of the impact point and imparting the linear velocity $V_1$ and $V_2$ to the material thrown away towards the elements 2 and 3 (see FIG. 9).

Deviations of the piece flight directions of the material to be crushed and thrown by the rotor off correspond to the Gaussian law determining that the pieces of small size are thrown off closer to the rotor towards the first secondary crushing rotor and the larger pieces are thrown off away from the rotor towards the second secondary crushing rotor. The velocity of the large pieces especially destroyed to small extent or not destroyed exceeds the circumferential velocity of the rotor rotor; this fact is not contrary to the classical theory of the impact. Dividing the flow of the thrown material on the line of the most probable partition of the large and small pieces corresponding to the mode M, the interaction of the material and the secondary crushing rotors occurs at the distances $R_1$ and $R_2$. This interaction can occur simultaneously, if $R_2=R_1(V_2/V_1)$.

At the moment of the interaction of the material to be crushed and the impact surfaces of the elements 2 and 3 the surface of the element 2 along the arc AB and the surface of the element 3 along the arc CD are disposed concentrically relative to the point T, where the rotor carries out the primary impact at the pieces of the material to be crushed; hence the large pieces will be crushed the most efficiently. The pieces of the material crushed by the element 3 are thrown off at the velocity $V_{a2}$ to the additional secondary crushing rotor 4 and the crushed by the element 2 material is thrown off at the velocity $V_{a1}$ to the limiters 6 and 7 and the limiter 8 and their openings are used for unloading and withdrawal of the crushed product. The material is reflected by the element 4 towards the limiter 8, where the material is intensively unloaded under the action of the element 2 (see FIG. 10). The buffer 12 can have openings in accordance with the requirements for the final product of the crushing.

The results shown at the table were obtained throughout the experiments.

It is remarkable that fine grinding was achieved at very low specific power consumption, when the limiters contained the large openings.

TABLE

| Material to be crushed | Size of raw material, mm Max. | Avg. | Average size of crushed product, mm | Reduction ratio | Size of openings in the limiters, mm | Specific power consumption, kWh per ton |
|---|---|---|---|---|---|---|
| Granite | 350 | 250 | 2.0 | 125 | 30 | 0.20 |
| Quartzite | 70 | 40 | 0.56 | 71 | 10 | 0.18 |
| Dolomite | 150 | 95 | 2.1 | 45 | 12 | 0.09 |
| Complex (polymetallic) ore | 300 | 180 | 2.2 | 90 | 20 | 0.06 |

Significantly increased crushing efficiency and quality of the final product and the main feature of the very low power consumption per ton of the grinded material, which is less than three and more times than crushing methods in operation, reliably demonstrate that the proposed method provides new parameters and features for the ore pretreatment process and non-metallic mineral as well.

There has also appeared a possibility to control the fineness of the crushed material through setting of the necessary operational parameters as well.

The invention claimed is:

1. A method of crushing material comprising the steps of:

feeding the material to a rotor;

crushing the material by said rotor to pieces of different sizes;

forwarding said pieces of different sizes to at least two secondary crushing rotors;

hitting the pieces of a first size on impact surfaces of the first secondary crushing rotor;

hitting the pieces of a second size on the impact surfaces of the second secondary crushing rotor;

adjusting an angle between the impact surface of the each secondary crushing rotor with respect to the movement directions of these material pieces to a value from approximately 76 to approximately 104 degrees at the moment of the impact, hitting said pieces on said impact surfaces at a time interval between impacts of the first and second secondary crushing rotors defined with use of the expression $$\Delta t=(0.7\ldots1.3)(R_1/V_1-R_2/V_2),$$

where $R_1$ is a distance from a place, where the most distant from the rotor rotation axis point of the impact surface of the rotor is at the minimum distance from the end of a feed track, to the place, where the first secondary crushing rotor hits the material pieces of said first size, $R_2$ is a distance from the place, where the most distant from the rotor rotation axis point of the impact surface of the rotor is at the minimum distance from the end of the feed track, to the place, where the second secondary crushing rotor impacts the pieces of said second size, $V_1$ is an average velocity of the pieces of said first size forwarded towards the first secondary crushing rotor, and $V_2$ is an average velocity of the pieces of said second size forwarded towards the second secondary crushing rotor.

2. The method of claim 1, further including the step of:

directing the flow of said pieces with concentric shapes and concentric arrangement located on at least one of said impact surfaces of said secondary crushing rotor.

3. The method of claim 1, further including the step of:

forwarding pieces which interact with the second secondary crushing rotor to a zone located under the first secondary crushing rotor.

4. The method of claim 1, wherein the step of crushing is performed in accordance with the relations $$V_1=(0.1\ldots0.35)(V_p+V_{a1}),$$

$$V_2=(0.1\ldots0.35)(V_p+V_{a2}),$$

where $V_p$ is the linear velocity of the most distant from the rotor rotation axis point of the impact surface of the rotor, $V_{a1}$ and $V_{a2}$ are the linear velocities of the pieces most distant from corresponding secondary crushing rotor rotation axes points of the impact surfaces of the first and second secondary crushing rotors, is set by adjustment of the velocities of the rotor and the secondary crushing rotors, and the material interacted with the secondary crushing rotors is forwarded to limiters set tangentially relative to the direction of the pieces motion.

5. The method of claim 1, further including the step of: withdrawing pieces of less than 0.2 millimeters from the process by means of a suction devices.

* * * * *